United States Patent [19]

Ganz

[11] 4,161,907

[45] Jul. 24, 1979

[54] CARTON FORMING MACHINE

[75] Inventor: Robert H. Ganz, Saddle River, N.J.

[73] Assignee: Ganz Brothers, Inc., Bergenfield, N.J.

[21] Appl. No.: 808,086

[22] Filed: Jun. 20, 1977

[51] Int. Cl.[2] ..... B31B 1/30; B31B 1/44

[52] U.S. Cl. ..... 93/51.1; 93/44

[58] Field of Search ..... 93/51.1, 51 R, 44, 44.1 R, 93/DIG. 1, 59 ES, 49 R

[56] References Cited

U.S. PATENT DOCUMENTS

| | | | |
|---|---|---|---|
| 2,599,008 | 6/1952 | Palmer | 93/51.1 |
| 2,912,907 | 11/1959 | Walther | 93/44 |
| 2,974,571 | 3/1961 | Windstrup et al. | 93/51.1 X |
| 3,147,168 | 9/1964 | Bateman | 93/DIG. 1 |

*Primary Examiner*—James F. Coan

*Attorney, Agent, or Firm*—Charles E. Brown

[57] ABSTRACT

This relates to a carton forming machine for automatically erecting cartons on a continuous bases wherein the cartons are of the type coated with a heat sealable plastics material. A single forming well is provided and forming heads carried by an endless conveyor repeatedly move carton blanks through the forming well to effect the erecting thereof, followed by the heat sealing of flaps to maintain the erected state of the cartons, followed by the taking away of the cartons and stacking the same.

12 Claims, 6 Drawing Figures

CARTON FORMING MACHINE

This invention relates in general to new and useful improvements in carton forming machines, and more particularly to a machine for automatically erecting cartons from flat blanks and effecting the securement of the flaps thereof to maintain the erected state of such cartons.

It is known to provide carton blanks formed of paperboard having a plastics material coating on the opposite faces thereof, which coatings are heat sealable to one another wherein after the carton blank has been folded into the form of an erected carton, the flaps of the carton may be directly heat sealed to adjacent panels to maintain the erected state of such cartons. The plastics material may include polyesters which are heat bondable at 280° C. and such cartons are suitable for packaging of food products and are sufficiently ovenproof to be used for the direct cooking of the products in ovens and the like.

In accordance with the known method, a forming well is provided, and a forming head, carried by a reciprocating plunger, drives a flat carton blank through the forming well to erect a carton therefrom, and after the carton blank passes through the forming well and the forming head reaches a predetermined fixed position, special sealing means engage the carton under very high pressures and very high heat conditions to effect the sealing of the flaps to the end panels. Thereafter, the forming head is withdrawn through the forming well to its starting position after which a next carton blank is positioned between the forming head and the forming well ready for the erecting of the next carton. It is quite apparent that this operation is comparitively slow and the output of such a carton forming machine has much to be desired.

In accordance with this invention, a single forming well is utilized, but plural forming heads are provided. The forming heads are carried by an endless conveyor for sequential movement through the forming well and cartons are positioned between each forming head and the forming well and moved on a continuous basis through the forming well. After the erected carton, carried by a forming head, passes through the forming well, suitable heat sealers engage the carton to heat seal the flaps thereof to the end panels.

In accordance with this invention, while it is feasible that the forming heads may move on an intermittent basis and the heat sealers could be stationary, it is preferred that the heat sealers be in the form of moving pads which tightly clamp the flaps against the end panels of the erected carton, which end panels are backed up by the forming heads. Thus, the carton forming operation may be on a continuous basis.

The erected cartons may be readily removed from the forming heads by stripper elements which move at a greater linear rate than the forming heads and grip and engage erected cartons and move them away from the forming heads in the same direction of travel as the forming heads. The stripper mechanism then disposes the stripped cartons in a suitable storage area, preferably in nested relation within a hopper.

It is to be understood that there are two primary features of the carton machine in question. First, the forming well, instead of being a customary 360° forming well, is an interrupted forming well so that the supports for the forming heads may pass through the forming well without interference. Secondly, the forming heads are also peripherally discontinuous and are provided with notches so that the stripper members may pass through the forming heads to strip the erected cartons therefrom.

With the above, and other objects in view that will hereinafter appear, the nature of the invention will be more clearly understood by reference to the following detailed description, the appended claims and the several views illustrated in the accompanying drawings.

IN THE DRAWINGS

FIGS. 3*a, b, c* and *d* are enlarged fragmentary horizontal sectional views taken through the forming well and show the position and function of forming elements of the forming well in a sequential application.

Figures 1, 3:
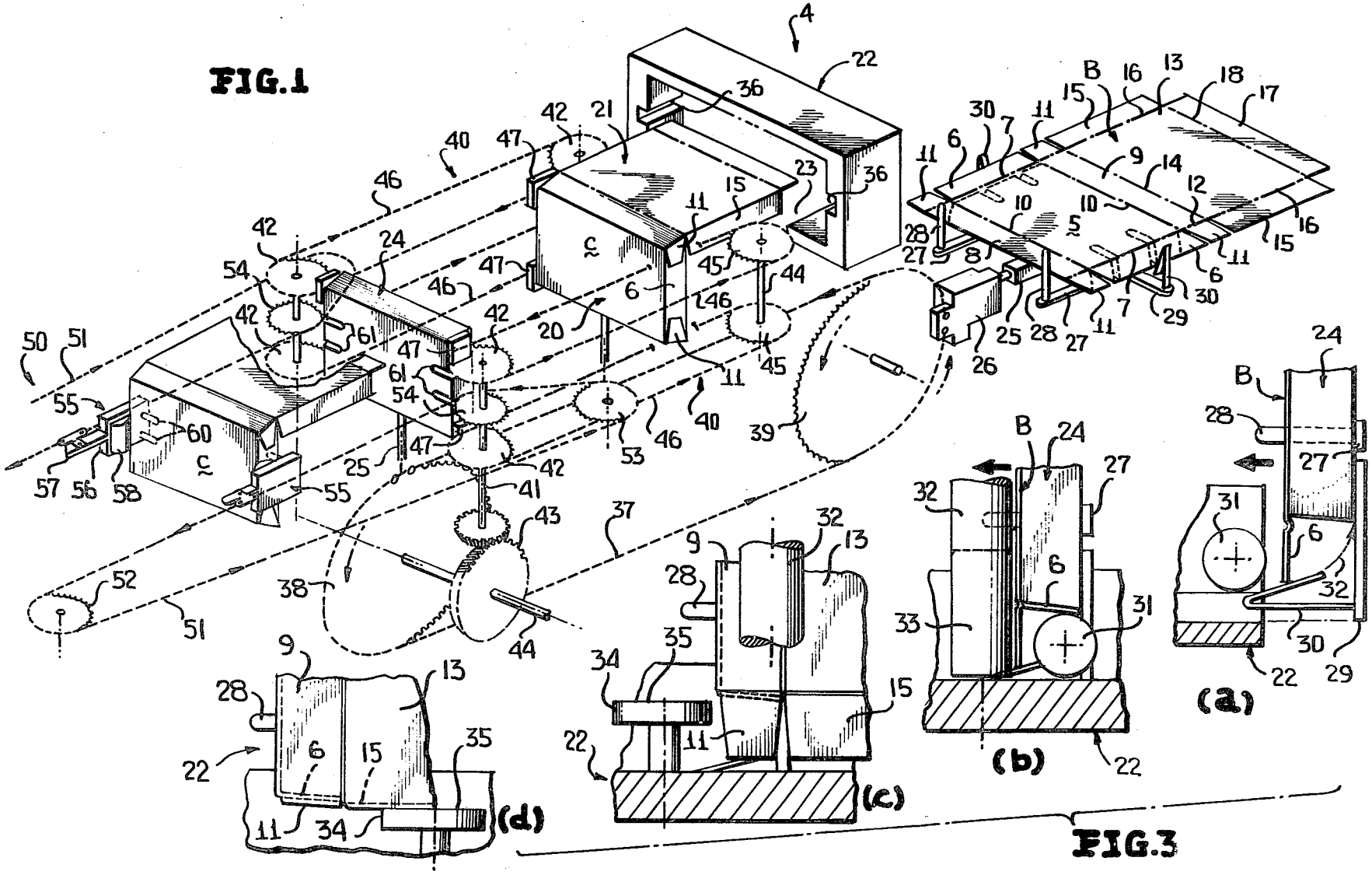
FIG. 1 is a schematic perspective view showing the carton forming machine and the relationship of the various components thereof.

Referring now to the drawings in detail, it will be seen that there is illustrated in FIG. 1 a carton blank B which is to be erected into a carton C. The illustrated carton blank B is a typical carton which is provided with an integral cover. For descriptive purposes, the carton blank B is to be understood to include a bottom panel 5, a pair of end panels 6 connected to the bottom panel 5 along fold lines 7, and side panels 8, 9 connected to the bottom panel 5 along fold lines 10. Each of the side panels 8, 9 is provided with securing flaps 11 at opposite ends thereof, each securing flap 11 being connected to its associated side panel along a fold line 12, the fold lines 12 being in alignment with the fold lines 7.

It is to be understood that the aforedescribed blank components may constitute the entire carton C in the event it is to be of the tray type. However, the carton C illustrated herein is provided with an integral cover panel 13 which is connected to the side panel 9 along a fold line 14. At the opposite ends of the cover panel 13 there are end flaps 15 connected thereto along fold lines 16 which are also in alignment with the fold lines 7. An end closing flap 17 is connected to the cover panel 13 along a fold line 18 remote from the fold line 14.

Figure 2:
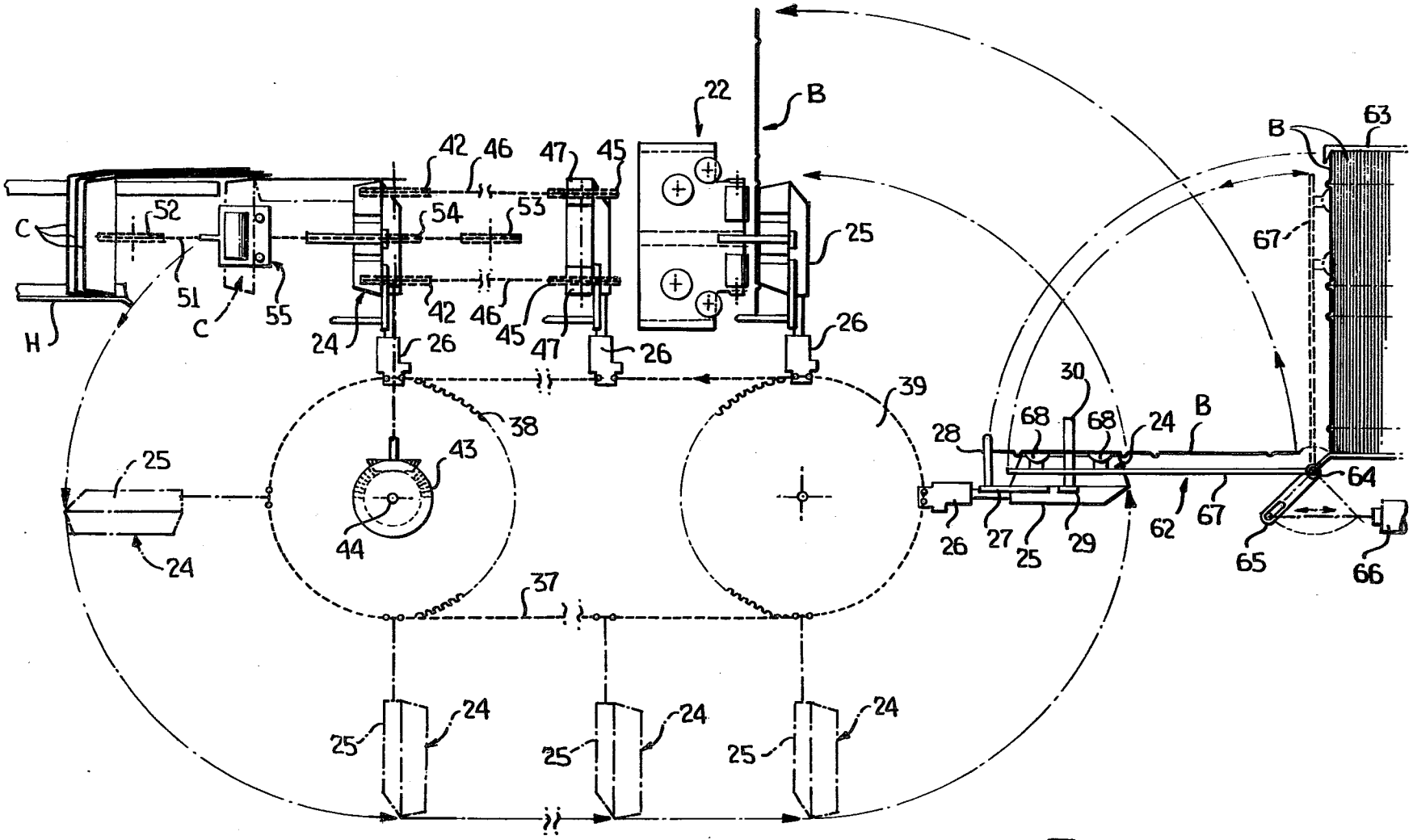
FIG. 2 is a schematic side elevational view of the carton forming machine of FIG. 1 and shows further the details thereof.

At this time it is pointed out that it is preferred that the tray portion of the carton C, which tray portion is generally identified by the numeral 20, is preferably of an upwardly flaring configuration so that tray portions of the next adjacent carton C may next one within the other, as shown in FIG. 2 and as will be described hereinafter. It is also to be noted that cover portions, generally identified by the numeral 21, will project from the tray portions 20 generally normal to the general plane of the respective tray portion.

In accordance with this invention, the forming apparatus specifically includes a forming well, generally identified by the numeral 22. The forming well 22 may be of varying construction. However, in accordance with this invention it is necessary that the forming well be peripherally discontinuous, i.e. it does not extend a full 360°, and is provided with a recess 23 through which endless carrier means for forming heads may pass.

The carton forming machine, which is generally identified by the numeral 4, also includes a plurality of forming heads, each generally identified by the numeral 24. Each forming head 24 is of a size and configuration to be snugly received within the tray portion 20. Each forming head 24 is carried by a support arm 25 which is part of a carrier 26. Each support arm 25 is secured to the rear surface of its respective forming head 24 in the direction of travel.

Also secured to the rear surface of each forming head 24 in the same general direction as the respective carrier 26 is a pair of arms 27 which carry positioning pins 28. The positioning pins 28 engage the free edges of the side panels 28 and have rounded upper ends to insure against hang-up of blanks being seated on the associated forming head.

Extending from the opposite sides of each forming head 24 at the rear surface thereof is a pair of arms 29 with each arm 29 carrying an upstanding, reversely folded spring blade clip 30. The clips 30 engage the free edges of the end panel 6 and serve both to automatically align a carton blank 5 with an associated forming head 24 and also to retain a blank on the forming head until the blank engages the forming well 22.

In order that one may more thoroughly understand the operation of the forming well 22, there is illustrated schematically in FIG. 3 constructional details of typical forming apparatus which may be carried by the forming well 22. As shown in FIG. 3*a*, at opposite sides of the forming well 22 there are vertically disposed rollers 31, the rollers 31 at each side being vertically spaced to provide clearance for the clip 30 and its associated arm 29. As the carton blank B enters the forming well 22, the end panels 6 are engaged by the rollers 31 and are restrained thereby as the central portion of the blank B passes between the rollers 31. As a result, the end panels 6 are swung rearwardly to positions alongside the forming head 24 as indicated by the dotted line with arrow 32.

As the end panels 6 are being folded rearwardly or subsequent to such folding, the side panels 8, 9 are engaged by horizontally disposed rollers so as to restrain the movement of such side panels as the blank B continues to pass through the forming well 22. It is to be understood that these rollers may include a continuous top roller 32 and a pair of spaced bottom rollers 33. The top roller 32 engages the side panel 9 while the bottom rollers 32 engage the side panel 8. It is to be understood that the bottom rollers 33 are sufficiently spaced so as to permit the arms 25 and 27 to pass therebetween.

It is also to be understood that when the side panel 8 is folded relative to the bottom panel 5, the flaps 11 carried thereby will be folded together therewith. In a like manner when the side panel 9 is folded relative to the bottom panel 5, the flaps 11 carried therewith will be folded as will also the cover 13 and the panels 15 and 17 carried thereby.

After the end panels 8, 9 have been folded along side forming head 24, further movement of the carton blank B and the forming head through the forming well 22 will result in the flaps 11 and 15 being engaged by rollers 34 having flat end faces 35 opposing the forming head 24. The rollers 34, which are four in number, will engage the flaps 11 and fold them alongside the forming head 24 into overlapping relation with respect to the respective end panel 6. The upper ones of the rollers 34 will thereafter engage the flaps 15 and fold them generally downwardly relative to the cover panel 13. As is best illustrated in FIG. 3*d*, the end faces 35 of the rollers 34 will effectively press the end flaps 11 tightly against the end panels 6.

At this time it is pointed out that the forming well 22 has been illustrated as being provided with slots 36 in the opposite sides thereof for the passage of the clips 30 and the arms 29 supporting the same. It is to be understood that these are primarily schematic representations and, depending upon the construction of the forming well 22, may not exist per se.

In accordance with the invention, there are a plurality of the forming heads 24 and these forming heads are sequentially passed through the forming well 22 on a continuous basis. In order to effect this movement, the carriers 26 are carried by an endless conveyor which is preferably in the form of an endless chain 37. The endless chain 37 is carried by a drive sprocket 38 and an idler sprocket 29. While no guides have been illustrated, it is to be understood that during the passage of each forming head 24 through the forming well 22, each carrier 26 and the associated chain 37 will be rigidly guided by suitable guide surfaces (not shown).

Disposed along opposite sides of the path of the cartons C downstream of the forming well 22 are heat sealing units, generally identified by the numeral 40. Each heat sealing unit 40 includes a drive shaft 41 which has mounted thereon a pair of drive sprockets 42. Each drive shaft 41 is preferably driven by means of gearing 43 carried by a drive shaft 44 which carries the drive sprocket 38.

Each sealing unit 40 also includes an idler shaft 44 which is disposed adjacent to the forming well 22 and carries a pair of vertically spaced idler sprockets 45. Entrained over each pair of sprockets 42, 45 is an endless conveyor chain 46 which carries a plurality of heat sealing pads 47. Each heat sealing pad 47 preferably includes a silicon block which can apply sufficient heat to effect the sealing of the flaps 11 to the end panels 6 without the flaps 11 sticking to the heat sealing pads 47.

It is to be understood that the runs of the chains 46 disposed adjacent the paths of the forming heads 24 and the erected cartons C will be suitably guided by means of cams and guides (not shown) so as to tightly force the pads 47 against the flaps 11 and the flaps 11, in turn, against the end panels 6. It is also to be understood that suitable heating means will be provided for heating the heat sealing pads 47. The heating means may be electrical heating means built into the sealing pads 47 or auxiliary heat means may be applied to the sealing pads 47 remote from the erected cartons C. Inasmuch as the manner in which the heat sealing pads 47 is heated is not a part of this invention and since it will be optional, no attempt has been made here to illustrate specific heating means.

It is also particularly pointed out here that the heat sealing pads 47 move at the same speed as the forming heads 24 so that there is no relative movement between them during the sealing of the flaps 11 to the end panels 6. In the illustrated form of the invention, the heat sealing pads 47 are spaced in accordance with the spacing of the forming heads. It is to be understood, however, that when the cartons being erected are limited to the tray portion 20 and there are no closing flaps 15 which would be engaged by the heat sealing pads unnecessarily, the heat sealing pads may be disposed in closely adjacent relation.

After the flaps 11 have been heat sealed to the end panels 6, the cartons C are ready to be removed from the forming heads 24. In order to automatically effect this, there is provided a stripper mechanism, generally identified by the numeral 50. The stripper mechanism 50 includes two endless conveyors 51, one disposed on each side of the path of movement of the erected cartons C. Each endless conveyor 51 is entrained over a pair of remote sprockets 52, 53, one of which is a drive sprocket, and an intermediate idler sprocket 54. The idler sprocket 54 is mounted on a respective one of the drive shafts 41 for relative rotation.

Carried by the endless conveyors 51 are stripper units 55. Each stripper unit 55 includes a support 56 having a mounting arm 57 securing it to its respective conveyor 51. Each support 56 is provided with a resilient pad 58 which is engagable with an end panel 6 of an erected carton C.

The support 56 carries upstream of its pad 58 a pair of stripper pins 60 which are vertically spaced.

It is to be understood that the stripper mechanism 50 functions with the supports 55 moving at a faster rate than for forming heads 24. The supports 55 converge towards the opposite ends of each forming head 24 so that as each support 55 moves about its respective sprocket 54, the resilient pad 58 engages the end panel 6 opposing the same. Thus, the resilient pads 58 tightly grip the end panels to the extent that when the cartons C are removed from the forming heads 24, the gripping of the end panels will be sufficient to hold the cartons between the supports 55.

In order to permit the stripper finger 60 to pass through the forming heads 24, each forming head 24 is provided therethrough at opposite ends thereof with notches 61 spaced in accordance with the spacing of the stripper pins of fingers 60. The stripper pins of fingers 60 engage the free edges of the end panels 6 and positively remove the erected cartons C from the forming heads 24.

It is to be understood that the stripper mechanism 50 moves the cartons C sufficiently fast so that they clear the forming heads 24 as the forming heads swing down and around the sprocket 38.

The stripper mechanism 50 feeds the erected cartons C into a horizontal hopper H as is shown in FIG. 2. When the tray portions 20 are tapered, the tray portions of adjacent cartons C will nest, as is illustrated. It is to be understood that the cartons are moved into the hopper H sufficiently by the stripper mechanism 50 as to be retained therein and each newly applied carton will move the preceding cartons further into the hopper. The nested cartons may be removed from the hopper by an attendant or other conveying means.

It is to be understood that the blanks B may be placed on the forming heads 24 in any desired manner. However, there is illustrated in FIG. 2 a blank loading mechanism, generally identified by the numeral 62. The blank loading mechanism 62 includes a hopper 63 in which blanks B are stored, preferably in a vertical position. A shaft 64 is mounted at the lower front edge of the hopper 63 for oscilatory movement and this shaft 64 is provided with an actuating lever 65 to effect the oscilation thereof. A suitable actuator 66 is connected to the lever 65.

Carried by the shaft 64 adjacent opposite ends thereof are arms 67 which carry suction cups 68. The suction cups 68 are preferably connected to a vacuum source (not shown) having valve means therein for relieving the vacuum in the suction cups 68 once the arms reach the position illustrated in solid lines in FIG. 2.

It will be readily apparent that the suction cups 68 first grip a foremost blank B in the hopper 63 and then swing that blank down and to the left, applying the blank to the underlying forming head 24 with the blank being guided into position relative to the forming head by the pins 28 and the clips 30. Since the blank B is still held by the suction cups 68 at the time it is forced down between the clips 30, it will be seen that the blank will be stripped from the suction cups 68 by only the engagement thereof with the surface of the forming head 24. Thus, the clips 30 will function to both guide the blank into a centered position with respect to the forming head and to retain the blank firmly affixed to the face of the forming head.

It is also pointed out here at this time that while there is but a single forming well 22 and a single series of forming heads 24, it is feasible to form the carton forming machine to have plural forming wells 22 in adjacent side-by-side relation and to have plural forming heads 24 mounted on a single support bar extending between two conveyor members. In such event, instead of the notch 23 being formed at the bottom of the forming well 22, it would be necessary for there to be two notches, one along each end of the forming well generally in the positions of the slots 36. In other words, the forming well would be formed of two opposed generally U-shaped halves.

It is also to be understood that while the machine has been illustrated and described in a horizontal position, it may equally as well be oriented vertically with the forming heads either moving a carton blank upwardly through a forming well or downwardly through a forming well. In such event, if the blanks B are to be fed horizontally, they may be fed into position relative to the forming heads by conventional feed rolls.

Although only a preferred embodiment of the invention has been specifically illustrated and described herein, it is to be understood that minor variations may be made in the carton forming machine without departing from the spirit and the scope of the invention, as defined by the appended claims.

I claim.

1. Apparatus for erecting cartons from flat carton blanks, said apparatus comprising a fixed forming well generally lying in a vertical plane, a plurality of forming heads each of a configuration for cooperating with said folding well for forming a carton blank into an erected carton during the passage of the carton blank through said forming well, first carrier means for moving said forming heads in spaced relation along a closed path including a generally horizontal straight line portion extending through said forming well, sealing means for sealing cartons erected in said forming well in their erected state, second carrier means for moving said sealing means along said path portion in cooperation with said forming heads, stripper members for removing erected and sealed cartons from said forming heads, and third carrier means for moving said stripper members along said path portion in timed relation to movement of said forming heads, and horizontally disposed hopper means for receiving cartons stripped from said forming heads.

2. The apparatus of claim 1 wherein said stripper means include resilient clamp means for gripping and temporarily holding erected cartons stripped from said forming blocks.

3. The apparatus of claim 1 wherein said first carrier means generally lie in a vertical plane and said second and third carrier means generally lie in a horizontal plane.

4. The apparatus of claim 1 wherein each forming head during travel along said path assumes a generally horizontal position in advance of passage of said forming head through said forming well, and transfer means for supplying a carton blank to each forming head at said generally horizontal position.

5. The apparatus of claim 4 together with carton blank aligning and holding means carried by each of said forming heads for positioning and retaining a carton blank relative to each forming head.

6. The apparatus of claim 1 wherein said forming well has carton blank folding means mounted therein, all of said carton blank folding means being in the form of rollers mounted for rotation about fixed axes.

7. The apparatus of claim 6 wherein said rollers include a first set of rollers for folding a first pair of carton panels to erect positions, a second set of rollers for folding a second pair of carton panels to erect positions, and a third set of rollers for folding securing flaps carried by one pair of said folded carton panels into overlapping relation to the other pair of folded carton panels.

8. The apparatus of claim 7 wherein said apparatus is particularly constructed to erect cartons of the type including a closure panel having end panels, and at least certain ones of said rollers of said third set forming means for folding the closure panel end panels relative to the closure panel.

9. An apparatus for erecting cartons from carton blanks having thereon a heat sealable coating, said apparatus comprising a forming well, a plurality of forming heads each of a configuration cooperative with said forming well for forming a carton blank into an erected carton during the passage thereof through said forming well by one of said forming heads, carrier means mounting said forming heads in spaced relation for continuous sequential movement through said forming well, and heat sealing means disposed along the path of movement of said forming heads downstream of said forming well for sealing cartons carried by said forming heads to maintain their erected state, said heat sealing means being in the form of heated pads movable in unison with said forming heads.

10. An apparatus for erecting cartons comprising a forming well, a plurality of forming heads each of a configuration cooperative with said forming well for forming a carton blank into an erected carton during the passage thereof through said forming well by one of said heads, and carrier means mounting said forming heads in spaced relation for continuous sequential movement through said forming well, said forming well having carton blank folding means mounted therein, all of said carton blank folding means being in the form of rollers mounted for rotation about fixed axes, said rollers including a first set of rollers for folding a first pair of carton panels to erect positions, a second set of rollers for folding a second pair of carton panels to erect positions, and a third set of rollers for folding securing flaps carried by one pair of said folded carton panels into overlapping relation to the other pair of folded carton panels.

11. The apparatus of claim 10 wherein said apparatus is particularly constructed to erect cartons of the type including a closure panel having end panels, and at least certain ones of said rollers of said third set forming means for folding the closure panel end panels relative to the closure panel.

12. The apparatus of claim 10 together with sealing means disposed along the path of movement of said forming heads downstream of said forming well for sealing the folded securing flaps to the other pair of folded carton panels.

* * * * *